US005104757A

United States Patent [19]

Koyama et al.

[11] Patent Number: 5,104,757

[45] Date of Patent: Apr. 14, 1992

[54] ELECTROPHOTOGRAPHIC PHOTOSENSITIVE MEMBER HAVING AN IMPROVED INTERMEDIATE LAYER

[75] Inventors: Takashi Koyama; Hideki Anayama, both of Yokohama; Yuichi Hashimoto, Tokyo, all of Japan

[73] Assignee: Canon Kaubshiki Kaisha, Tokyo, Japan

[21] Appl. No.: 493,326

[22] Filed: Mar. 14, 1990

[30] Foreign Application Priority Data

Mar. 15, 1989 [JP] Japan ..... 1-64776

[51] Int. Cl.[5] ..... G03G 5/14

[52] U.S. Cl. ..... 430/60; 430/62; 430/64

[58] Field of Search ..... 430/60, 61, 62, 63, 430/64, 65

[56] References Cited

U.S. PATENT DOCUMENTS

| | | | |
|---|---|---|---|
| 4,632,892 | 12/1986 | Yashiki et al. | 430/58 |
| 4,657,835 | 4/1987 | Yashiki | 430/60 |
| 4,895,782 | 1/1990 | Koyama et al. | 430/58 |
| 4,904,557 | 2/1990 | Kubo | 430/58 |
| 4,908,288 | 3/1990 | Anayama | 430/58 |

FOREIGN PATENT DOCUMENTS

| | | |
|---|---|---|
| 26141 | 4/1973 | Japan . |
| 30936 | 4/1973 | Japan . |
| 10044 | 1/1974 | Japan . |
| 126149 | 11/1976 | Japan . |
| 10138 | 1/1977 | Japan . |
| 20836 | 2/1977 | Japan . |
| 25638 | 2/1977 | Japan . |
| 100240 | 8/1977 | Japan . |
| 48523 | 5/1978 | Japan . |
| 89435 | 8/1978 | Japan . |
| 26738 | 2/1979 | Japan . |
| 103556 | 8/1980 | Japan . |
| 143564 | 11/1980 | Japan . |
| 60448 | 5/1981 | Japan . |
| 90639 | 6/1982 | Japan . |
| 106549 | 6/1982 | Japan . |

*Primary Examiner*—John Goodrow

*Attorney, Agent, or Firm*—Fitzpatrick, Cella, Harper & Scinto

[57] ABSTRACT

An electrophotographic photosensitive member comprises a conductive support and provided thereon a photosensitive layer, interposing an intermediate layer between them. The intermediate layer contains a polyether polyamide.

12 Claims, 1 Drawing Sheet

ELECTROPHOTOGRAPHIC PHOTOSENSITIVE MEMBER HAVING AN IMPROVED INTERMEDIATE LAYER

BACKGROUND OF THE INVENTION

1. Field of the Invention

The present invention relates to an electrophotographic photosensitive member. More particularly, it relates to an electrophotographic photosensitive member comprising an intermediate layer having both functions as an adhesive layer and a barrier layer, provided between a support and a photosensitive layer.

1. Related Background Art

In general, in electrophotographic photosensitive members of a Carlson type, charge characteristics of photosensitive members, i.e., the stabilities at dark portion potential and light portion potential, are important in order to obtain a good image having a constant image density and also free of background staining in the course of the repetition of a process comprising the steps of charging, imagewise exposure, transfer, cleaning, and pre-exposure.

In photosensitive members having laminated structure in which the photosensitive layer is functionally separated into a charge generation layer and a charge transport layer, the charge generation layer is commonly provided as a very thin layer of, for example, about 0.5 μm thick, so that defects, stain, deposits or scratches on the surface of a support may cause non-uniformity in the film thickness of the charge generation layer. Non-uniformity of the film thickness of the charge generation layer causes uneven sensitivity in the photosensitive member, and hence it is required to make the charge generation layer as uniform as possible. It is also known that its adhesion to the support influences the characteristics of the photosensitive member.

Under such circumstances, it has been hitherto proposed that an intermediate layer having a function as a barrier layer and a function as an adhesive layer is provided between the charge generation layer and the support.

As materials to form the layer provided between the photosensitive layer and the support, it is conventionally known to use polyamides (Japanese Patent Application laid-open No. 46-47344 and No. 52-25638, polyesters (Japanese Patent Application laid-open No. 52-20836 and No. 54-26738), polyurethanes (Japanese Patent Application laid-open No. 49-10044 and No. 53-89435), casein (Japanese Patent Application laid-open No. 55-103556), polypeptides (Japanese Patent Application laid-open No. 53-48523), polyvinyl alcohols (Japanese Patent Application laid-open No. 52-100240), polyvinyl pyrrolidone (Japanese Patent Application laid-open No. 48-30936), a vinyl acetate-/ethylene copolymer (Japanese Patent Application laid-open No. 48-26141), a maleic anhydride ester polymer (Japanese Patent Application laid-open No. 52-10138), polyvinyl butyral (Japanese Patent Application laid-open No. 57-90639 and No. 58-106549), quaternary ammonium salt-containing polymers (Japanese Patent Application laid-open No. 51-126149 and No. 56-60448), ethyl cellulose (Japanese Patent Application laid-open No. 55-143564), etc.

In the electrophotographic photosensitive members that use the above materials in the intermediate layer, however, the resistance of the intermediate layer may change with changes in temperature and humidity, and therefore it has been difficult to obtain potential characteristics and images that can be always stable to all environmental conditions of from the low temperature and low humidity to the high temperature and high humidity.

For example, when a photosensitive member is repeatedly used under conditions of low temperature and low humidity that increase the resistance of the intermediate layer, electric charge remains in the intermediate layer and hence the light portion potential and residual potential increase to cause fog on a copied image. When such a photosensitive member is used in a printer of an electrophotographic system in which reversal development is carried out, there have been the problems that the resulting image has a low density and no copies with constant image quality are obtainable.

Under conditions of high temperature and high humidity, the function as a barrier is lowered because the intermediate layer changes to have a low resistance, resulting in a lowering of the dark portion potential because of an increase in the injection of carriers from the support side. Thus, under conditions of the high temperature and high humidity, there have been the problems that the resulting copied image has a low density, and black-spot faulty fog tends to occur in the image when such a photosensitive member is used in the printer of an electrophotographic system in which reversal development is carried out.

SUMMARY OF THE INVENTION

An object of the present invention is provide an electrophotographic photosensitive member having an improved intermediate layer.

Another object of the present invention is to provide an electrophotographic photosensitive member capable of obtaining potential characteristics and images that are stable to all environmental conditions from low temperature and low humidity to high temperature and high humidity.

Stated summarily, the present invention provides an electrophotographic photosensitive member comprising a conductive support and provided thereon a photosensitive layer, interposing an intermediate layer between them, wherein said intermediate layer contains a polyether polyamide.

DESCRIPTION OF THE PREFERRED EMBODIMENTS

Figure 1:
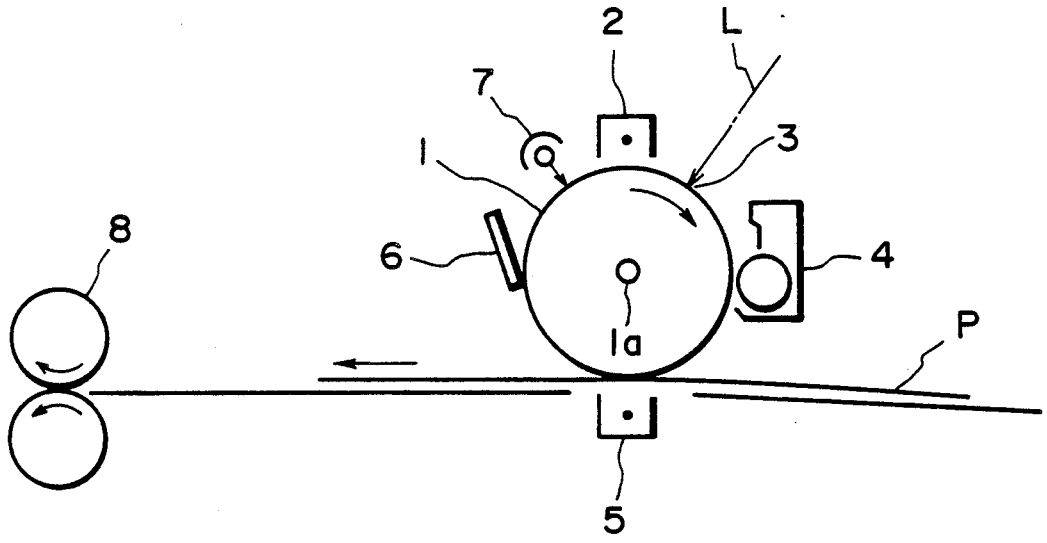
FIG. 1 schematically illustrates a common example for the constitution of a transfer-type electrophotographic apparatus in which a drum photosensitive member is used.

The polyether polyamide used in the present invention is a compound formed by polymerization or copolymerization using as a monomer component at least one of a polyetherdiamine, a polyether dicarboxylic acid, a polyether dicarboxylic acid ester, and a polyether dicarboxylic acid chloride. Such a monomer component having an ether group includes, for example, polyether diamines such as diethylene oxide diamine, tetrapropylene oxide diamine, and poly(propylene oxide) diamine; polyether dicarboxylic acids such as triethylene oxide dicarboxylic acid, hexapropylene oxide dicarboxylic acid, and poly(ethylene oxide) dicarboxylic acid; or derivatives of these, such as acid esters or acid chlorides thereof.

In the polyether polyamide of the present invention, in addition to the above monomer component having an ether group, diamines such as tetramethylenediamine, hexamethylenediamine, piperazine, metaphenylenediamine, and paraphenylenediamine; dicarboxylic acids such as adipic acid, sebacic acid, isophthalic acid, and terephthalic acid, or derivatives of these, such as dicarboxylic acid esters or acid chlorides; lactams having a cyclic amide structure, such as caprolactam, and laurolactam, may be used as a monomer for copolymerization with the monomer containing an ether group.

The polyether polyamide of the present invention may preferably have a weight average molecular weight ranging from 15,000 to 120,000, and particularly from 20,000 to 100,000.

Examples of the polyether polyamide used are shown below. In the following, a, b, c and d each represent a constituent molar ratio of a random copolymer; n, a number average degree of polymerization; and Mw, weight average molecular weight.

The polyether polyamide of the present invention, however, is by no means limited to these. Exemplary Polymers:

[1]

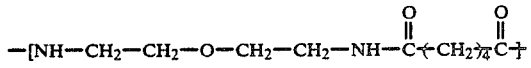

(Mw = 44,000)

[2]

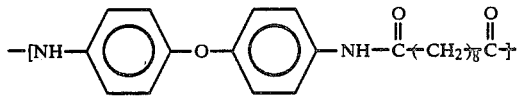

(Mw = 49,000)

[3]

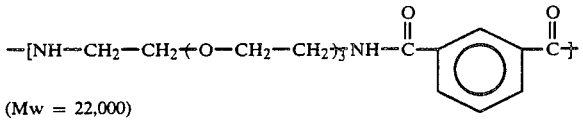

(Mw = 22,000)

[4]

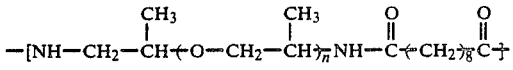

(n = 4.2, Mw = 37,000)

[5]

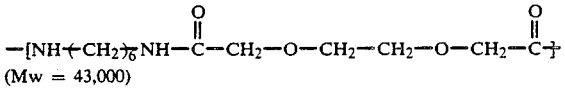

(Mw = 43,000)

[6]

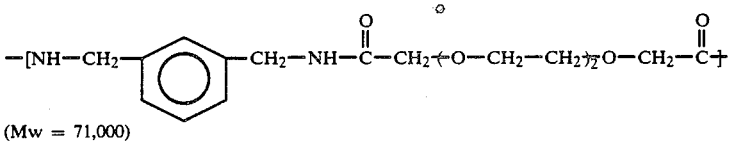

(Mw = 71,000)

[7]

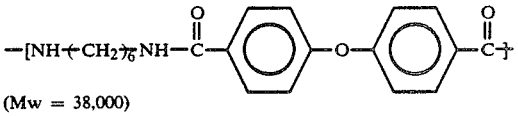

(Mw = 38,000)

[8]

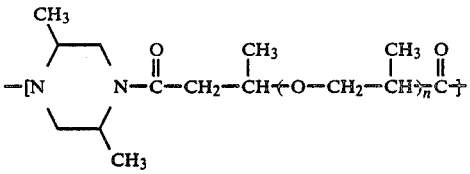

(n = 7.8, Mw = 24,000)

[9]

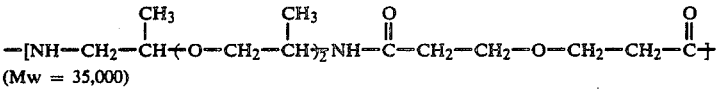

(Mw = 35,000)

[10]

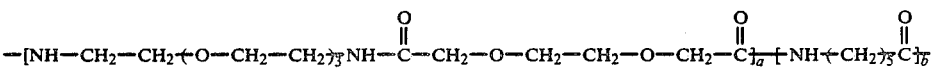

(a:b = 3:1, Mw = 96,000)

-continued
[11]
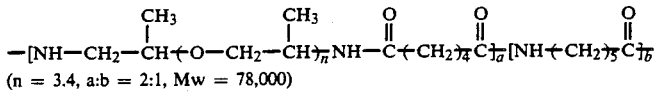
(n = 3.4, a:b = 2:1, Mw = 78,000)
[12]
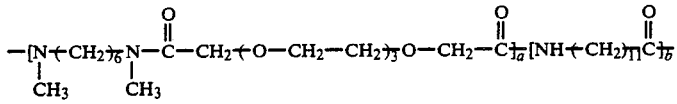
(a:b = 3:2, Mw = 23,000)
[13]
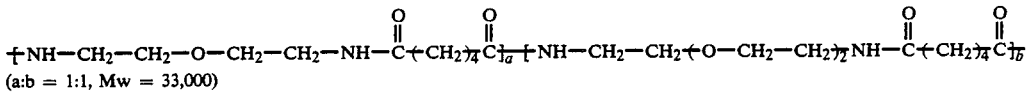
(a:b = 1:1, Mw = 33,000)
[14]
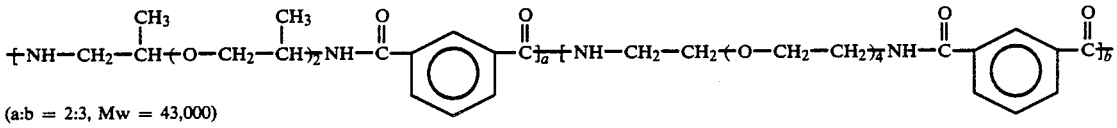
(a:b = 2:3, Mw = 43,000)
[15]
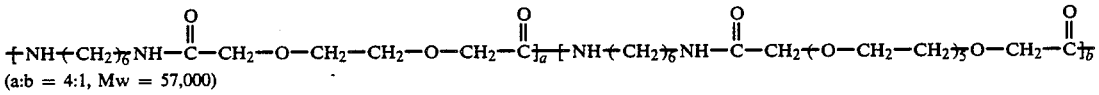
(a:b = 4:1, Mw = 57,000)
[16]
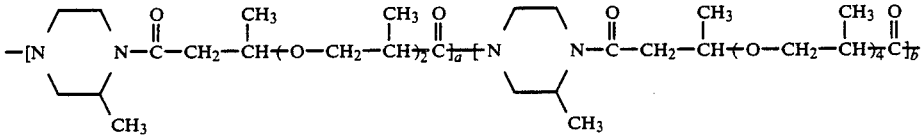
(a:b = 1:1, Mw = 66,000)
[17]
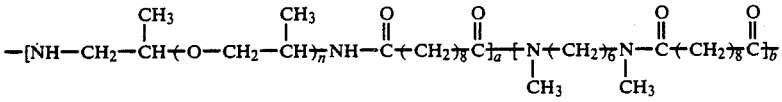
(a:b = 4:1, n = 7.8, Mw = 64,000)
[18]
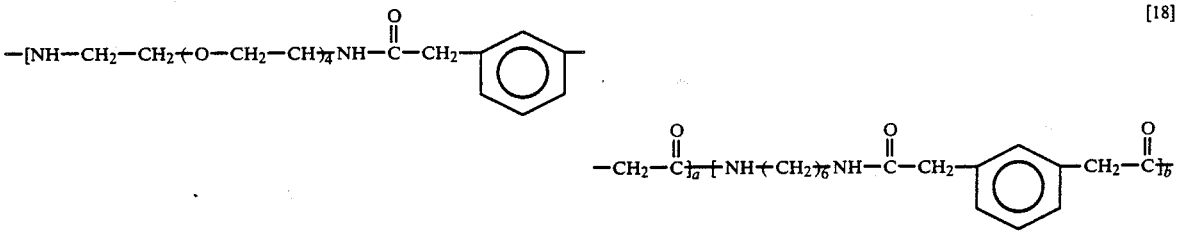
(a:b = 3:1, Mw = 23,000)
[19]
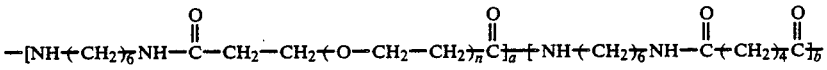
(a:b = 2:1, n = 3.6, Mw = 32,000)
[20]
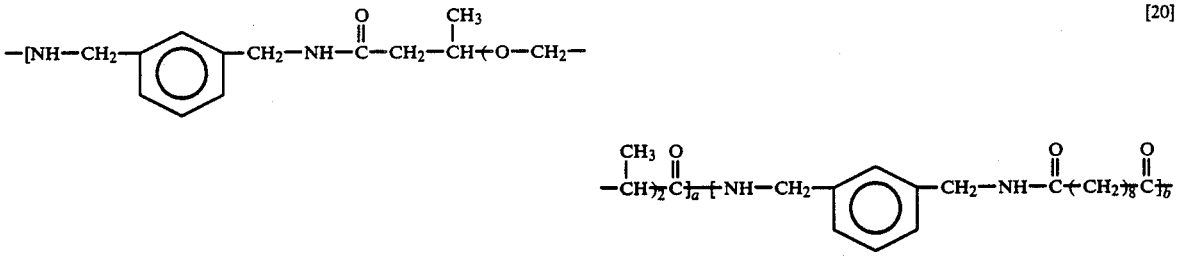
(a:b = 3:1, Mw = 45,000)
[21]
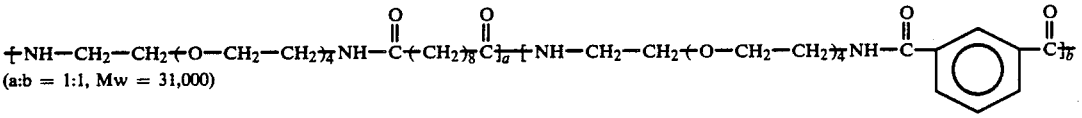
(a:b = 1:1, Mw = 31,000)

-continued

[22]

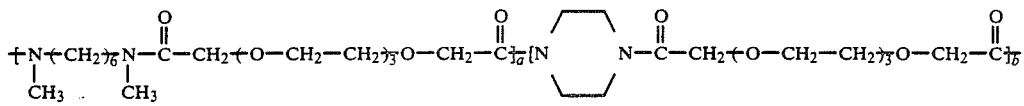

(a:b = 3:1, Mw = 87,000)

[23]

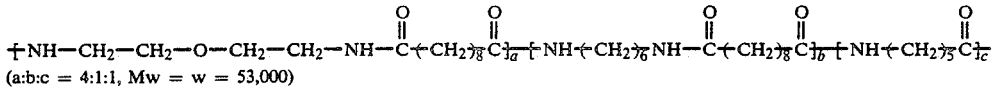

(a:b:c = 4:1:1, Mw = w = 53,000)

[24]

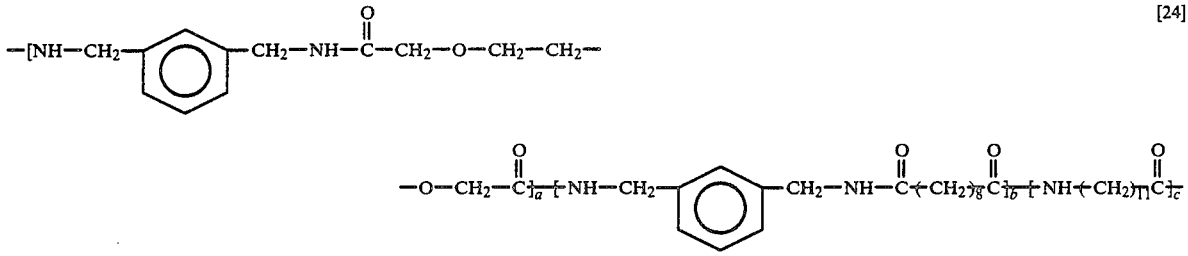

(a:b:c = 2:1:1, Mw = 76,000)

[25]

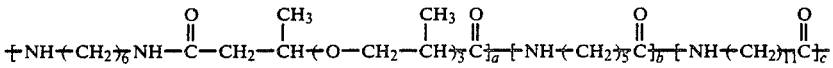

(a:b:c = 3:2:1, Mw = 34,000)

[26]

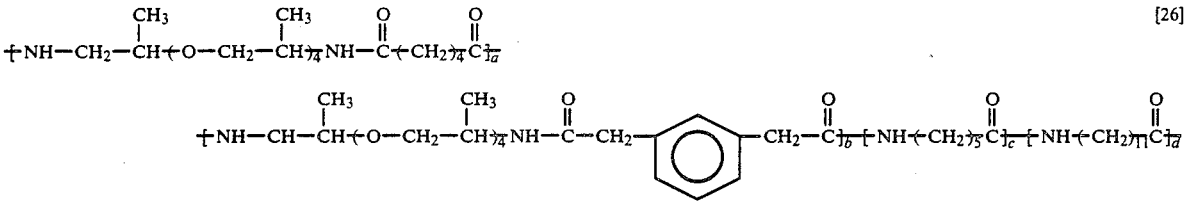

(a:b:c:d = 4:2:1:1, Mw = 42,000)

The polyether polyamide of the present invention can be synthesized by polycondensation or copolycondensation according to the same method as in usual polyamide syntheses, such as melt polymerization, solution polymerization or interfacial polymerization, using as monomers the diamine component and the dicarboxylic acid component. At least one of the diamine component and dicarboxylic acid component has an ether group.

Specific synthesis examples of the polyether polyamide of the present invention will be described below.

SYNTHESIS EXAMPLE 1

Exemplary polymer (3)

In 200 g of chloroform, 5.77 g (0.03 mol) of polyetherdiamine represented by the structural formula: $H_2N—CH_2—CH_2—(—O—CH_2—CH_2—)_3—NH_2$, and 10.0 g of triethylamine were dissolved to prepare a polyether diamine solution.

Next, 6.09 g (0.03 mol) of isophthalic acid dichloride was dissolved in 200 g of chloroform to prepare an isophthalic acid dichloride solution.

The resulting diamine solution and acid dichloride solution were mixed in an atmosphere of room temperature, and the mixture was stirred for 20 minutes to carry out polymerization. Next, the resulting reaction mixture was dropwise added in 3,000 g of n-hexane for reprecipitation to give a polymer precipitate. Subsequently, the polymer precipitate was subjected to further reprecipitation carried out twice using methanol and methyl ethyl ketone, respectively, followed by drying under reduced pressure, to give 9.38 g of the exemplary polymer (3) polyether polyamide (yield: 97%).

SYNTHESIS EXAMPLE 2

Exemplary polymer (5)

In 150 g of ion-exchanged water, 10.33 g (0.04 mol) of hexamethylenediamine and 3.5 g of sodium hydroxide were dissolved to prepare a diamine solution.

Next, 6.45 g (0.03 mol) of polyether dicarboxylic acid dichloride represented by the structural formula:

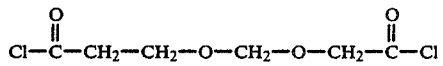

was dissolved in 150 g of chloroform to prepare an acid chloride solution.

The resulting diamine solution and acid chloride solution were mixed in an atmosphere of room temperature, and the mixture was vigorously stirred for 5 minutes to carry out polymerization. The polymer precipitate thus deposited was filtered. Subsequently, the polymer precipitate was further subjected to reprecipitation carried out twice using methanol and methyl ethyl ketone, respectively, followed by drying under reduced pressure, to give 7.13 g of the exemplary polymer (5), polyether polyamide (yield: 92%).

The intermediate layer of the present invention may be formed of the above polyether polyamide alone, or may optionally formed of a system in which different type of resins, additives, or conductive materials have been added. The different type of resins added here include, for example, solvent-soluble nylons such as copolymer nylons and N-alkoxymethylated nylons, polyurethanes, polyureas, polyesters, and phenol resins. The additives include, for example, powders such as titanium oxide and alumina, surface active agents, leveling agents, and coupling agents.

When the conductive materials are used, they include metallic powders, metallic foils and metallic short fibers, of aluminum, copper, nickel, silver, etc.; conductive metal oxides such as antimony oxide, indium oxide, and tin oxide; polymeric conductive materials such as polypyrrole, polyaniline, and polymeric electrolytes; carbon fiber, carbon black, and graphite powder; organic and inorganic electrolytes; or conductive powders whose particle surfaces have been coated with these conductive materials.

In the present invention, the intermediate layer may have a thickness of from 0.1 to 30 μm, usually from 0.5 to 5 μm, and preferably from 1 to 30 μm when the conductive material is contained. The intermediate layer can be formed by coating methods such as dip coating, spray coating, and roll coating.

In the present invention, a second intermediate layer mainly composed of a resin may also be optionally provided on or under the intermediate layer for the purpose of, e.g., controlling barrier properties.

The resin used in the second intermediate layer includes polyether polyamides, as well as copolymer nylons, N-alkoxymethylated nylons, polyurethanes, polyureas, polyesters, and phenol resins.

The second intermediate layer may preferably have a thickness of from 0.1 μm to 5 μm, and can be formed by coating in the same manner as in the first-mentioned intermediate layer.

In the present invention, the photosensitive layer may be of either laminated structure, functionally separated into the charge generation layer and charge transport layer, or single layer structure.

In the case of the photosensitive layer of laminated structure, the charge generation layer can be formed by dispersing an organic charge-generating material including azo pigments such as Sudan Red and Diane Blue, quinone pigments such as pyrenequinone and anthanthrone, quinocyanine pigments, perylene pigments, indigo pigments such as indigo and thioindigo, azulenium salt pigments, and phthalocyanine pigments such as copper phthalocyanine, in a binder resin such as polyvinyl butyral, polystyrene, polyvinyl acetate, acrylic resins, polyvinyl pyrrolidone, ethyl cellulose, or acetate butyrate cellulose, and coating the resulting dispersion. Such a charge generation layer may have a film thickness of not more than 5 μm, and preferably from 0.05 μm to 2 μm.

The charge transport layer can be formed using a coating solution containing an organic charge-transporting material including polycyclic aromatic compounds with the structure having biphenylene, anthracene, pyrene, phenanthrene or the like at the backbone chain or side chain, nitrogen-containing cyclic compounds such as indole, carbazole, oxadiazole and pyrazoline, hydrazone compounds, and styryl compounds, which may be optionally dissolved in a resin optionally having film-forming properties.

The resin having such film-forming properties includes polyesters, polycarbonate, polymethacrylates, and polystyrene.

The charge transport layer may have a thickness of from 5 μm to 40 μm, and preferably from 10 μm to 30 μm.

The photosensitive member of the laminate structure type may have the structure that the charge transport layer is laminated on the charge generation layer, or may have the structure that the charge generation layer is laminated on the charge transport layer.

In the case of the photosensitive member of the single layer type, it can be formed by incorporating into the resin the charge-generating material and charge-transporting material as described above.

In the present invention, a layer of an organic photoconductive polymer such as polyvinyl carbazole or polyvinyl anthracene, a selenium-deposited layer, a selenium-tellurium-deposited layer, or an amorphous silicone layer may also be used as the photosensitive member.

A resin layer, or a resin layer in which a conductive material has been dispersed, may also be provided as a protective layer on the photosensitive layer.

On the other hand, the conductive support used in the present invention may comprise any type of supports so long as they are conductive, and include, for example, those comprising a metal such as aluminum, copper, chromium, nickel, zinc, or stainless steel, molded or formed into drums or sheets, those comprising a plastic film laminated thereon with foil of a metal such as aluminum or copper, those comprising a plastic film on which aluminum, indium oxide, tin oxide or the like has been deposited, or metals, plastic films, papers or the like comprising a conductive layer provided by coating a conductive material alone or together with a suitable binder resin.

The conductive material used in this conductive layer includes, for example, those previously described.

The binder resin used in the conductive layer includes thermoplastic resins such as polyamides, polyesters, acrylic resins, polyamino acid esters, polyvinyl acetate, polycarbonate, polyvinyl formal, polyvinyl butyral, polyvinyl alkyl ethers, polyalkylene ethers, and polyurethane elastomers, and thermosetting resins such as heat-curable polyurethanes, phenol resins, and epoxy resins.

The conductive material and the binder resin may be mixed in a ratio of about 5:1 to 1:5. This mixing ratio is determined taking account of the resistivity, surface condition, and coating suitability, of the conductive layer.

In the case where the conductive material comprises a powder, a mixture is first prepared by a conventional method using a ball mill, a roll mill, a sand mill or the like, and then used.

A surface active agent, a silane coupling agent, a titanate coupling agent, a silicone oil, a silicone leveling agent, and so forth may also be added as other additives.

The electrophotographic photosensitive member of the present invention can be not only utilized in electrophotographic copying machines, but also used in laser printers, CRT printers, and systems of electrophotographic lithography.

FIG. 1 schematically illustrates the constitution of a transfer-type electrophotographic apparatus commonly used, in which a drum photosensitive member is used.

In FIG. 1, the numeral 1 denotes a drum photosensitive member serving as an image supporting member, which is rotated around a shaft 1a at a given peripheral speed in the direction shown by arrow. In the course of rotation, the photosensitive member 1 is uniformly charged on its periphery, with positive or negative given potential by the operation of a charging means 2, and then imagewise exposed to light L (slit exposure, laser beam scanning exposure, etc.) at an exposure area 3 by the operation of an imagewise exposure means (not shown). As a result, electrostatic latent images corresponding to the exposure images are successively formed on the periphery of the photosensitive member.

The electrostatic latent images thus formed are subsequently developed by toner by the operation of a developing means 4. The resulting toner-developed images are then successively transferred by the operation of a transfer means 5, to the surface of a transfer medium P which is fed from a paper feed section (not shown) to the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is brought to removal of the toner remaining after the transfer, using a cleaning means 6. Thus the photosensitive member is cleaned on its surface and then repeatedly used for the formation of images.

The charging means 2 for giving uniform charge on the photosensitive member 1 includes corona chargers, which are commonly put into wide use. As the transfer means 5, corona transfer means are also commonly put into wide use.

In the electrophotographic apparatus, plural components from among the constituents such as the above photosensitive member, developing means and cleaning means may be joined as one apparatus unit so that the unit can be freely mounted on or detached from the body of the apparatus. For example, the photosensitive member 1 and the cleaning means 6 may be joined into one apparatus unit so that the unit can be freely mounted or detached using a guide means such as a rail provided in the body of the apparatus. Here, the above apparatus unit may be so constituted as to be joined together with the charging means and/or the developing means.

EXAMPLES

The present invention will be described below in greater detail by specifically giving Examples. In the following, "part(s)" is by weight unless particularly mentioned.

EXAMPLE 1

Using a sand mill making use of glass beads of 1 mm in diameter, 50 parts of conductive titanium oxide powder comprising particles coated with tin oxide containing 10% of antimony oxide, 20 parts of a resol-type phenol resin, 20 parts of methyl cellosolve, 10 parts of methanol, and 0.002 part of silicone oil (a polydimethylsiloxane polyoxyalkylene copolymer; average molecular weight: 3,000) were dispersed for 3 hours to prepare a conductive layer coating solution.

On an aluminum cylinder (30 mm in diameter×260 mm in length), the above coating solution was dip coated, followed by drying at 140° C. for 30 minutes, to form a conductive layer with a film thickness of 20 μm.

Next, 4 parts of the polyether polyamide of exemplary polymer (1) previously shown was dissolved in 96 parts of methanol to prepare an intermediate layer coating solution.

The resulting coating solution was dip coated on the above conductive layer, followed by drying at 80° C. for 20 minutes, to form an intermediate layer with a film thickness of 0.5 μm.

Subsequently, 4 parts of a disazo pigment of the following structural formula:

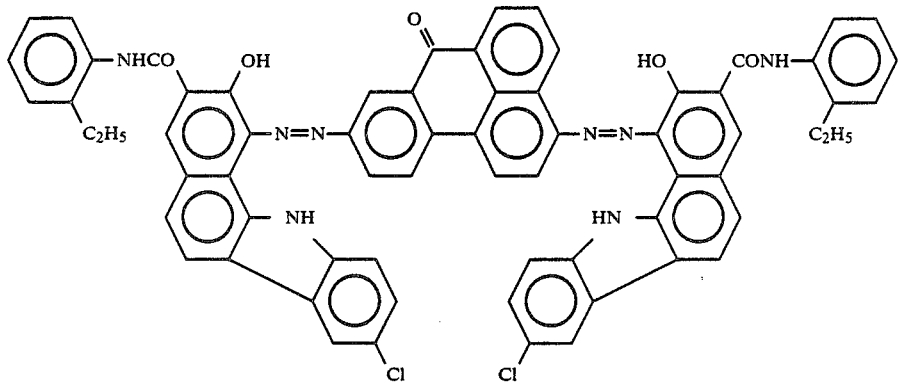

2 parts of polyvinyl benzal (rate of benzalation: 80%; weight average molecular weight: 21,000) and 40 parts of cyclohexanone were dispersed for 12 hours using a sand mill making use of glass beads of 1 mm in diameter, and then 60 parts of methyl ethyl ketone (MEK) was added. A dispersion for a charge generation layer was thus prepared. This dispersion was dip coated on the above intermediate layer, followed by drying at 80° C. for 20 minutes, to form a charge generation layer with a film thickness of 0.15 μm.

Next, 10 parts of a styryl compound of the following structural formula:

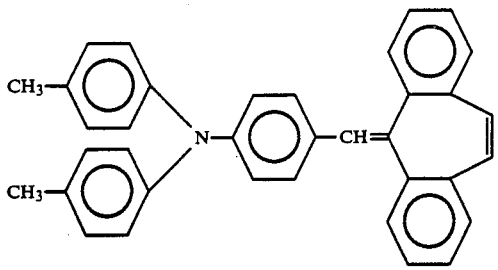

and 10 parts of polycarbonate (weight average molecular weight: 54,000) were dissolved in a mixed solvent composed of 20 parts of dichloromethane and 40 parts of monochlorobenzene. The resulting solution was dip coated on the above charge generation layer, followed by drying at 120° C. for 60 minutes, to form a charge transport layer with a film thickness of 20 μm.

The electrophotographic photosensitive member prepared in this way was fitted to a laser printer of a reversal development system in which a process comprising the steps of charging, laser exposure, development, transfer, and cleaning is repeated at a cycle of 1.5 seconds, and electrophotographic performance was evaluated under environmental conditions of ordinary temperature and ordinary humidity (23° C., 50% RH) and also under environmental conditions of high temperature and high humidity (34° C., 85% RH).

As a result, as Table 1 shows, in the photosensitive member of Example 1, the difference between dark portion potential ($V_D$) and light portion potential ($V_L$) was large enough to obtain a satisfactory potential contrast, and also the dark portion potential ($V_D$) was stable even under conditions of high temperature and high humidity. A good image, free from black-dot defects and fog, was thus obtained.

EXAMPLES 2 to 5

Example 1 was repeated to prepare electrophotographic photosensitive members, except that the polyether polyamides of exemplary polymers (6), (11), (16) and (21) were each used for the intermediate layer coating solution. The resulting photosensitive members were designated as Examples 2 to 5, respectively.

These photosensitive members were evaluated in the same manner as in Example 1. As a result, the dark portion potential ($V_D$) was stable even under conditions of high temperature and high humidity, giving a good image, free from black-dot defects and fog. The results are shown in Table 1.

COMPARATIVE EXAMPLE 1

Example 1 was repeated to prepare an electrophotographic photosensitive member as Comparative Example 1, except that the polyether polyamide used for the intermediate layer was replaced with an N-methoxymethylated 6 nylon resin (weight average molecular weight Mw: 150,000; rate of methoxymethyl group substitution: 29%).

The resulting photosensitive member was evaluated in the same manner as in Example 1. As a result, charging power became poor when operated under conditions of high temperature and high humidity, and a lowering of the dark portion potential ($V_D$) was seen, resulting in occurrence of black-dot defects on the image. The results are shown in Table 1.

TABLE 1

| | 23° C., 50% RH | | 34° C., 85% RH | |
|---|---|---|---|---|
| | Dark portion potential $V_D$ (−V) | Light portion potential $V_L$ (−V) | Dark portion potential $V_D$ (−V) | Image |
| Example: | | | | |
| 1 | 695 | 120 | 680 | Good |
| 2 | 680 | 145 | 675 | Good |
| 3 | 685 | 135 | 675 | Good |
| 4 | 705 | 125 | 690 | Good |
| 5 | 700 | 145 | 695 | Good |
| Comparative Example: | | | | |
| 1 | 705 | 150 | 610 | Black dots |

EXAMPLE 6

On an aluminum cylinder (80 mm in diameter×360 mm in length), a conductive layer with a film thickness of 20 μm was formed in the same manner as in

EXAMPLE 1.

Next, 6 parts of the polyether polyamide of exemplary polymer (6) as used in Example 2 was dissolved in 94 parts of methanol to prepare an intermediate layer coating solution.

The resulting intermediate layer coating solution was dip coated on the above conductive layer, followed by drying at 90° C. for 20 minutes, to form an intermediate layer with a film thickness of 0.8 μm.

Subsequently, 4 parts of a disazo pigment of the following structural formula:

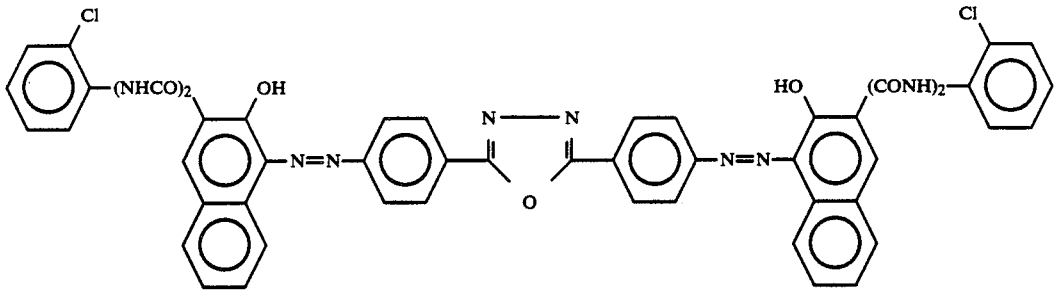

2 parts of polyvinyl butyral (rate of butyralation: 68%; weight average molecular weight: 22,000) and 34 parts of cyclohexanone were dispersed for 20 hours using a sand mill making use of glass beads of 1 mm in diameter, and then 60 parts of tetrahydrofuran (THF) was added.

A dispersion for a charge generation layer was thus prepared. This dispersion was dip coated on the above intermediate layer, followed by drying at 80° C. for 15 minutes, to form a charge generation layer with a film thickness of 0.18 μm.

Next, 10 parts of the styryl compound as used in Example 1 and 10 parts of polycarbonate (weight average molecular weight: 38,000) were dissolved in a mixed solvent composed of 40 parts of dichloromethane and 20 parts of monochlorobenzene. The resulting solution was dip coated on the above charge generation layer, followed by drying at 120° C. for 60 minutes, to form a charge transport layer with a film thickness of 22 μm.

The electrophotographic photosensitive member prepared in this way was fitted to a copying machine that repeats a process comprising the steps of charging, halogen exposure, development, transfer, and cleaning at a cycle of 0.6 second.

On the present photosensitive member, electrophotographic performance was evaluated under conditions of low temperature and low humidity (15° C., 15% RH).

As a result, in the present photosensitive member, a satisfactory potential contrast was obtained in initial-stage image formation. Images were further continuously produced on 1,000 sheets. As a result, as Table 2 shows, there was little increase in light portion potential ($V_L$), and very stable images were obtained.

EXAMPLES 7 to 10

Example 6 was repeated to prepare electrophotographic photosensitive members, except that the polyether polyamides of exemplary polymers (8), (12), (18) and (23) were each used for the intermediate layer coating solution. The resulting photosensitive members were designated as Example 7 to 10, respectively.

These photosensitive members were evaluated in the same manner as in Example 6. As a result, a satisfactory potential contrast was obtained in initial-stage image formation in every Example. Even after continuous image production on 1,000 sheets, there was also little increase in light portion potential ($V_L$), and very stable images were obtained. The results are shown in Table 2.

COMPARATIVE EXAMPLE 2

Example 6 was repeated to prepare an electrophotographic photosensitive member as Comparative Example 2, except that the polyether polyamide used for the intermediate layer was replaced with an alcohol-soluble copolymer nylon resin (weight average molecular weight: 78,000).

The resulting photosensitive member was evaluated in the same manner as in Example 6. As a result, the light portion potential ($V_L$) increased after continuously repeated copying on 1,000 sheets, resulting in generation of fog on the image. The results are shown in Table 2.

TABLE 2

| | Initial stage | | After continuous 1,000 sheet copying | |
|---|---|---|---|---|
| | Dark portion potential $V_D$ (−V) | Light portion potential $V_L$ (−V) | Light portion potential $V_L$ (−V) | Image |
| Example: | | | | |
| 6 | 750 | 180 | 195 | Good |
| 7 | 745 | 170 | 180 | Good |
| 8 | 730 | 160 | 185 | Good |
| 9 | 745 | 175 | 185 | Good |
| 10 | 735 | 165 | 175 | Good |
| Comparative Example: | | | | |
| 2 | 735 | 180 | 265 | Fogged |

EXAMPLE 11

Using a sand mill making use of glass beads of 1 mm in diameter, 30 parts of conductive titanium oxide powder comprising particles coated with tin oxide containing 10% of antimony oxide, 20 parts of a rutile tin oxide powder, 20 parts of the polyether polyamide of exemplary polymer (13) as previously shown, 20 parts of methanol, and 10 parts of 2-propanol were dispersed for 1 hour to prepare an intermediate layer coating solution.

On an aluminum cylinder (60 mm in diameter×260 mm in length), the above coating solution was dip coated, followed by drying at 160° C. for 40 minutes, to form an intermediate layer with a film thickness of 15 μm.

Next, 2 parts of a disazo pigment of the following structural formula:

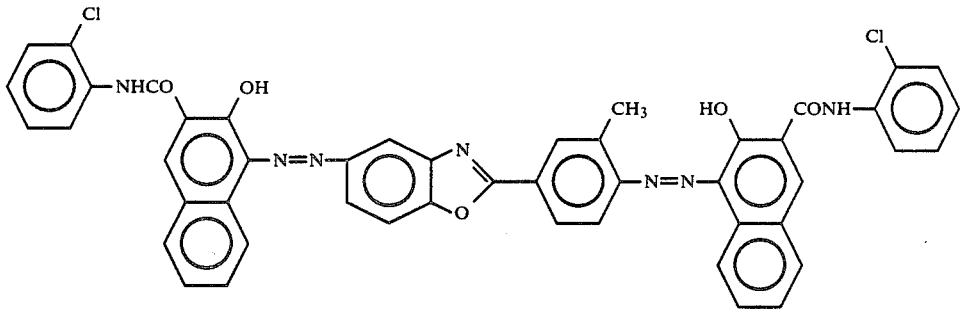

1 part of polyvinyl butyral (rate of butyralation: 72%; weight average molecular weight: 18,000) and 30 parts of cyclohexanone were dispersed for 10 hours using a sand mill making use of glass beads of 2 mm in diameter, and then 65 parts of MEK was added. A dispersion for a charge generation layer was thus prepared. This dispersion was dip coated on the above intermediate layer, followed by drying at 80° C. for 15 minutes, to form a charge generation layer with a film thickness of 0.22 μm.

Next, 10 parts of a hydrazone compound of the following structural formula:

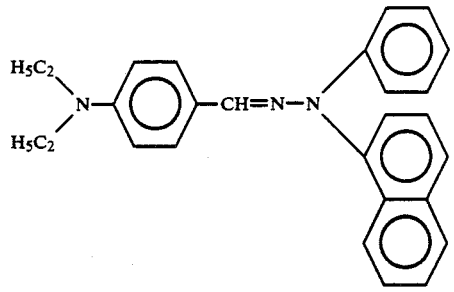

and 10 parts of polycarbonate (weight average molecular weight: 33,000) were dissolved in a mixed solvent composed of 20 parts of dichloromethane and 40 parts of monochlorobenzene. The resulting solution was dip coated on the above charge generation layer, followed by drying at 125° C. for 60 minutes, to form a charge transport layer with a film thickness of 24 μm.

The electrophotographic photosensitive member prepared in this way was fitted to a copying machine that repeats a process comprising the steps of charging, halogen exposure, development, transfer, and cleaning at a cycle of 0.8 second.

On the present photosensitive member, electrophotographic performance was evaluated under conditions of low temperature and low humidity (10° C., 10% RH).

In the present photosensitive member, a satisfactory potential contrast was obtained in initial-stage image formation. Images were further continuously produced on 1,000 sheets. As a result, as Table 3 shows, there was little increase in light portion potential ($V_L$), and very stable images were obtained.

EXAMPLE 12

Using a sand mill making use of glass beads of 1 mm in diameter, 50 parts of conductive titanium oxide powder comprising particles coated with tin oxide containing 15% of antimony oxide, 20 parts of the polyether polyamide of exemplary polymer (13) as previously shown, 20 parts of methanol, and 10 parts of 2-propanol were dispersed for 1 hour to prepare an intermediate layer coating solution.

On an aluminum cylinder (60 mm in diameter×260 mm in length), the above coating solution was dip coated, followed by drying at 100° C. for 40 minutes, to form an intermediate layer with a film thickness of 13 μm.

Next, 5 parts of an alcohol-soluble copolymer polyamide resin (weight average molecular weight: 47,000) was dissolved in 95 parts of methanol, and the resulting solution was dip coated on the above intermediate layer, followed by drying at 80° C. for 10 minutes, to form a second intermediate layer with a film thickness of 0.3 μm.

Subsequently, a charge generation layer and a charge transport layer were formed on the second intermediate layer in the same manner as in Example 11. An electrophotographic photosensitive member of Example 12 was thus prepared.

The present photosensitive member was evaluated in the same manner as in Example 11. As a result, a satisfactory potential contrast was obtained in initial-stage image formation. Even after continuous image production on 1,000 sheets, there was also little increase in light portion potential ($V_L$), and very stable images were obtained. The results are shown in Table 3.

COMPARATIVE EXAMPLES 3, 4

Examples 11 and 12 were repeated to prepare electrophotographic photosensitive members as Comparative Examples 3 and 4, respectively, except that the polyether polyamide used for the intermediate layer containing the conductive titanium oxide was replaced with a resol-type phenol resin.

The resulting photosensitive members were evaluated in the same manner as in Example 11. As a result, in Comparative Example 3, in which the charge generation layer and charge transport layer were directly provided on the intermediate layer, barrier properties of the intermediate layer was unsatisfactory, and potential contrast necessary for the formation of images was not obtained because of a low dark portion potential ($V_D$). In Comparative Example 4, in which the second intermediate layer was formed on the intermediate layer, the light portion potential ($V_L$) increased after continuously repeated copying on 1,000 sheets, resulting in generation of fog on the image. The results are shown in Table 3.

TABLE 3

| | | Initial stage | | After continuous 1,000 sheet copying | |
|---|---|---|---|---|---|
| | Second intermediate layer | Dark portion potential $V_D$ (−V) | Light portion potential $V_L$ (−V) | Light portion potential $V_L$ (−V) | Image |
| Example: | | | | | |
| 11 | Present | 685 | 130 | 135 | Good |
| 12 | Present | 695 | 145 | 155 | Good |
| Comparative Example: | | | | | |
| 3 | None | 380 | 120 | Not evaluable | |
| 4 | Present | 685 | 150 | 225 | Fogged |

What is claimed is:

1. An electrophotographic photosensitive member comprising a conductive support a photosensitive layer, and an intermediate layer therebetween; wherein said intermediate layer contains a polyether polyamide.

2. An electrophotographic photosensitive member according to claim 1, wherein said polyether polyamide is a compound formed by polymerization or copolymerization using as a monomer component at least one selected from the group consisting of a polyetherdiamine, a polyether dicarboxylic acid, a polyether dicarboxylic acid ester, and a polyether dicarboxylic acid chloride.

3. An electrophotographic photosensitive member according to claim 1, wherein said intermediate layer contains at least one resin selected from the group consisting of a copolymer nylon, an N-alkoxymethylated nylon, a polyurethane, a polyurea, a polyester, and a phenol resin.

4. An electrophotographic photosensitive member according to claim 1, wherein an additional intermediate layer is provided on or under the first-mentioned intermediate layer.

5. An electrophotographic photosensitive member according to claim 4, wherein said additional intermediate layer contains at least one resin selected from the group consisting of a polyether polyamide, a copolymer nylon, an N-alkoxymethylated nylon, a polyurethane, a polyurea, a polyester, and a phenol resin.

6. An electrophotographic photosensitive member according to claim 1, wherein said photosensitive layer is of laminated structure comprising a charge generation layer containing at least a charge-generating material and a charge transport layer containing at least a charge-transporting material.

7. An electrophotographic photosensitive member according to claim 6, wherein said charge transport layer is laminated on said charge generation layer.

8. An electrophotographic photosensitive member according to claim 6, wherein said charge generation layer is laminated on said charge transport layer.

9. An electrophotographic photosensitive member according to claim 6, wherein said charge-generating material comprises an organic material.

10. An electrophotographic photosensitive member according to claim 6, wherein said charge-transporting material comprises an organic material.

11. An electrophotographic photosensitive member according to claim 1, wherein said conductive support is in the form of a drum.

12. An electrophotographic photosensitive member according to claim 1, wherein a protective layer is provided on said photosensitive layer.

* * * * *

UNITED STATES PATENT AND TRADEMARK OFFICE

CERTIFICATE OF CORRECTION

PATENT NO. : 5,104,757

DATED : April 14, 1992

INVENTOR(S) : TAKASHI KOYAMA, ET AL.

It is certified that error appears in the above-identified patent and that said Letters Patent is hereby corrected as shown below:

COLUMN 14

Line 37, "as in" should read --as in Example 1.--.
Line 39, "EXAMPLE 1." should be deleted.

Signed and Sealed this

Sixth Day of July, 1993

Attest:

Michael K. Kirk

MICHAEL K. KIRK

Attesting Officer

Acting Commissioner of Patents and Trademarks